US005630548A

United States Patent [19]

Chih

[11] Patent Number: 5,630,548

[45] Date of Patent: May 20, 1997

[54] GUN TYPE WATER SPRAYING NOZZLE

[76] Inventor: I-Shun Chih, P.O. Box 1750, Taichung, Taiwan

[21] Appl. No.: 431,974

[22] Filed: May 1, 1995

[51] Int. Cl.[6] ..... B05B 1/16

[52] U.S. Cl. ..... 239/394; 239/526

[58] Field of Search ..... 239/390, 394, 239/526, 391, 436, 443

[56] References Cited

U.S. PATENT DOCUMENTS

| | | | |
|---|---|---|---|
| 2,991,945 | 7/1961 | Rosenkranz | 239/526 |
| 3,191,869 | 6/1965 | Gilmour | 239/526 X |
| 3,799,447 | 3/1974 | Beal | 239/526 X |
| 4,448,355 | 5/1984 | Roman | 239/526 |
| 4,903,897 | 2/1990 | Hayes | 239/394 |
| 5,232,162 | 8/1993 | Chih | 239/394 |
| 5,501,400 | 3/1996 | Kuo | 239/394 |

*Primary Examiner*—Kevin Weldon
*Attorney, Agent, or Firm*—Charles E. Baxley

[57] ABSTRACT

A water spraying gun includes a hand grip extended downward from a gun body and a handle pivotally coupled to the rear portion of the hand grip. A tube is engaged in the gun body and has a mouth formed in the middle portion and has a room formed in the front portion. A piston rod is slidably engaged in the tube and has a rear end coupled to a wall member extended in the inner portion of the handle such that the piston rod will not extend outward beyond the handle and such that the piston rod will not hurt the users. The piston rod includes a plug for engaging with and for enclosing the mouth.

1 Claim, 9 Drawing Sheets

GUN TYPE WATER SPRAYING NOZZLE

BACKGROUND OF THE INVENTION

1. Field of the Invention

The present invention relates to a nozzle, and more particularly to a gun type water spraying nozzle.

2. Description of the Prior Art

Typical water spraying guns are coupled to water reservoir for supplying water and for spraying water. The water spraying guns comprise a gun body having a hand grip extended downward therefrom and having a handle pivotally coupled to the hand grip for operating a piston rod. However, the piston rod of the typical water spraying guns normally comprise a rear end extended outward beyond the handle and engaged with a nut, or the piston rod is a bolt means having an enlarged head extended rearward and outward beyond the handle such that the hands of the users may be hurt by the nut or bolt head.

The present invention has arisen to mitigate and/or obviate the afore-described disadvantages of the conventional water spray guns.

SUMMARY OF THE INVENTION

The primary objective of the present invention is to provide a water spraying gun in which the piston rod does not extend outward beyond the handle such that the handle can be easily operated without hurting the hands of the users.

In accordance with one aspect of the invention, there is provided a water spraying gun comprising a gun body including a rear portion having a hand grip extended downward therefrom, the gun body including a water conduit and the hand grip including a water passage formed therein and communicating with the water conduit of the gun body, the hand grip including a rear portion, a handle pivotally coupled to the rear portion of the hand grip and including an upper portion having a wall member provided therein, a tube engaged in the gun body and including a middle portion having a mouth formed therein and including a front portion having a first peripheral wall formed therein so as to define a room, the room being communicating with the mouth and the tube, a piston rod slidably engaged in the tube and including a rear end coupled to the wall member of the handle and including a front end having a plug for engaging with and for enclosing the mouth, the piston rod including a middle portion having a plurality of fins extended radially outward therefrom for engaging with the tube so as to support the piston rod in place, and means for biasing the plug to engage with and to enclose the mouth of the tube.

The gun body includes a front portion having an annular flange formed thereon and having an annular rib extended radially outward from the annular flange, the water spraying gun further comprises a control ferrule engaged on the front portion of the gun body, the control ferrule including a front portion having a center portion including a plurality of holes formed therein and having a plurality of orifices formed around the center portion, the control ferrule including a rear portion having a first engaging means for engaging with the annular rib of the gun body so as to rotatably engaging the control ferrule to the gun body, the control ferrule including a middle portion having a ratchet tooth means extended radially inward therefrom, a control plate including ear means extended radially outward therefrom for engaging with the ratchet tooth means so as to secure the control plate to the control ferrule, the control plate including a plurality of bulges extended therefrom for engaging with the room of the tube and each having an opening formed therein for forming various kinds of water spraying forms.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
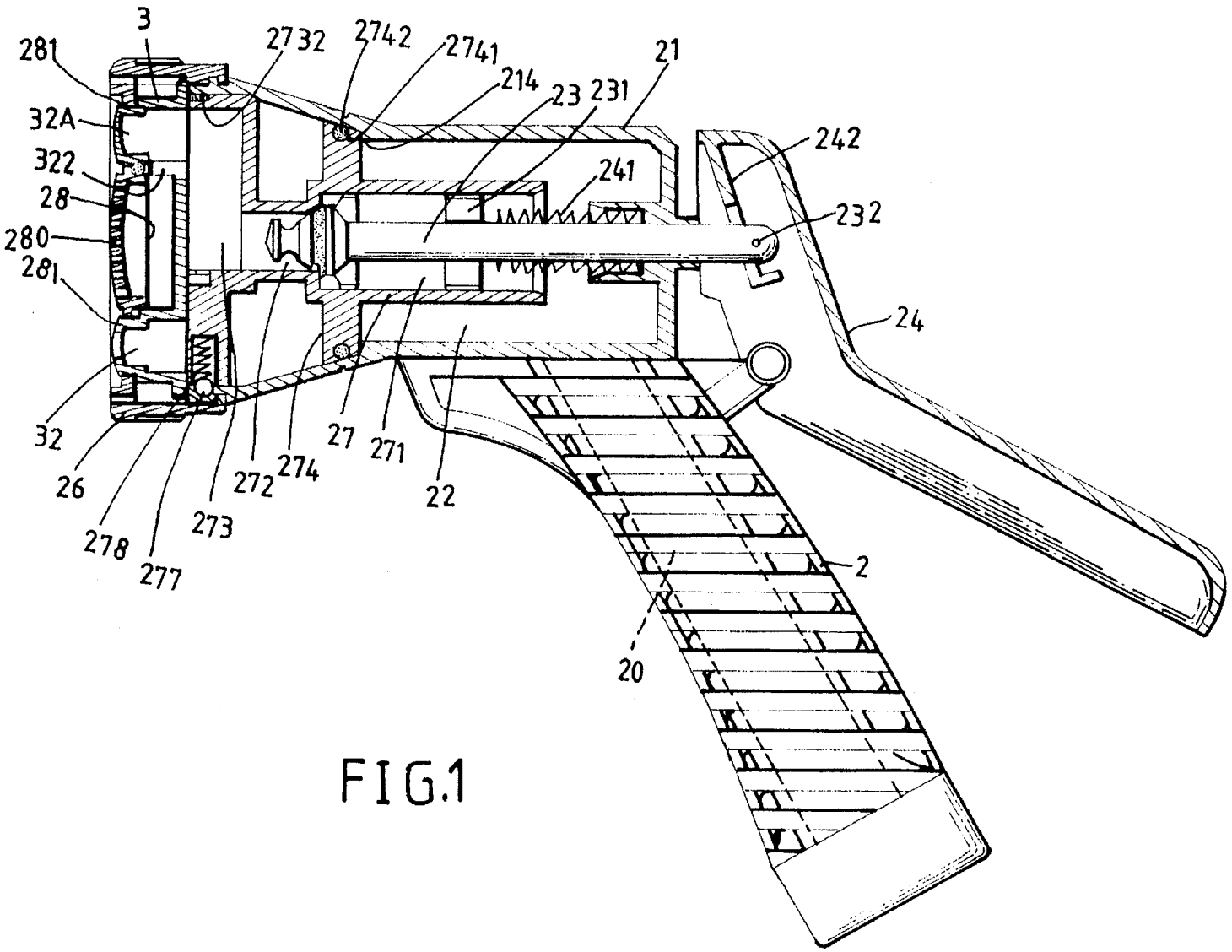
FIG. 1 is a cross sectional view of a water spraying gun in accordance with the present invention.
Figure 1C:
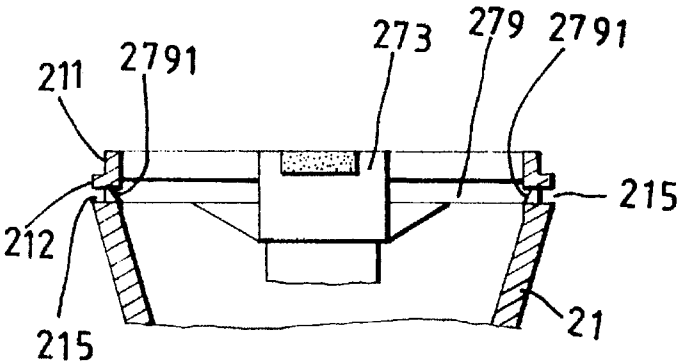
FIGS. 1A, 1B, 1C are partial cross sectional views of the water spraying gun.
Figure 1B:
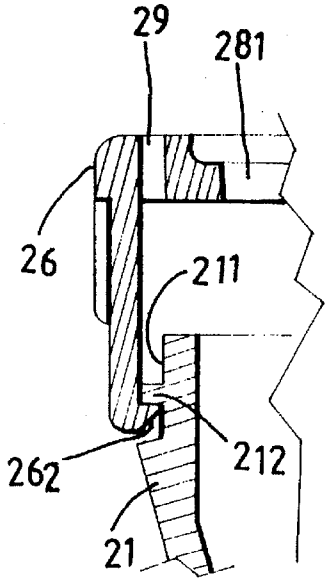
Figure 1A:
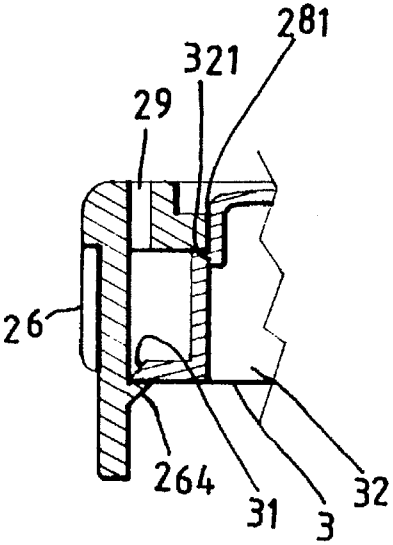
Figure 2:
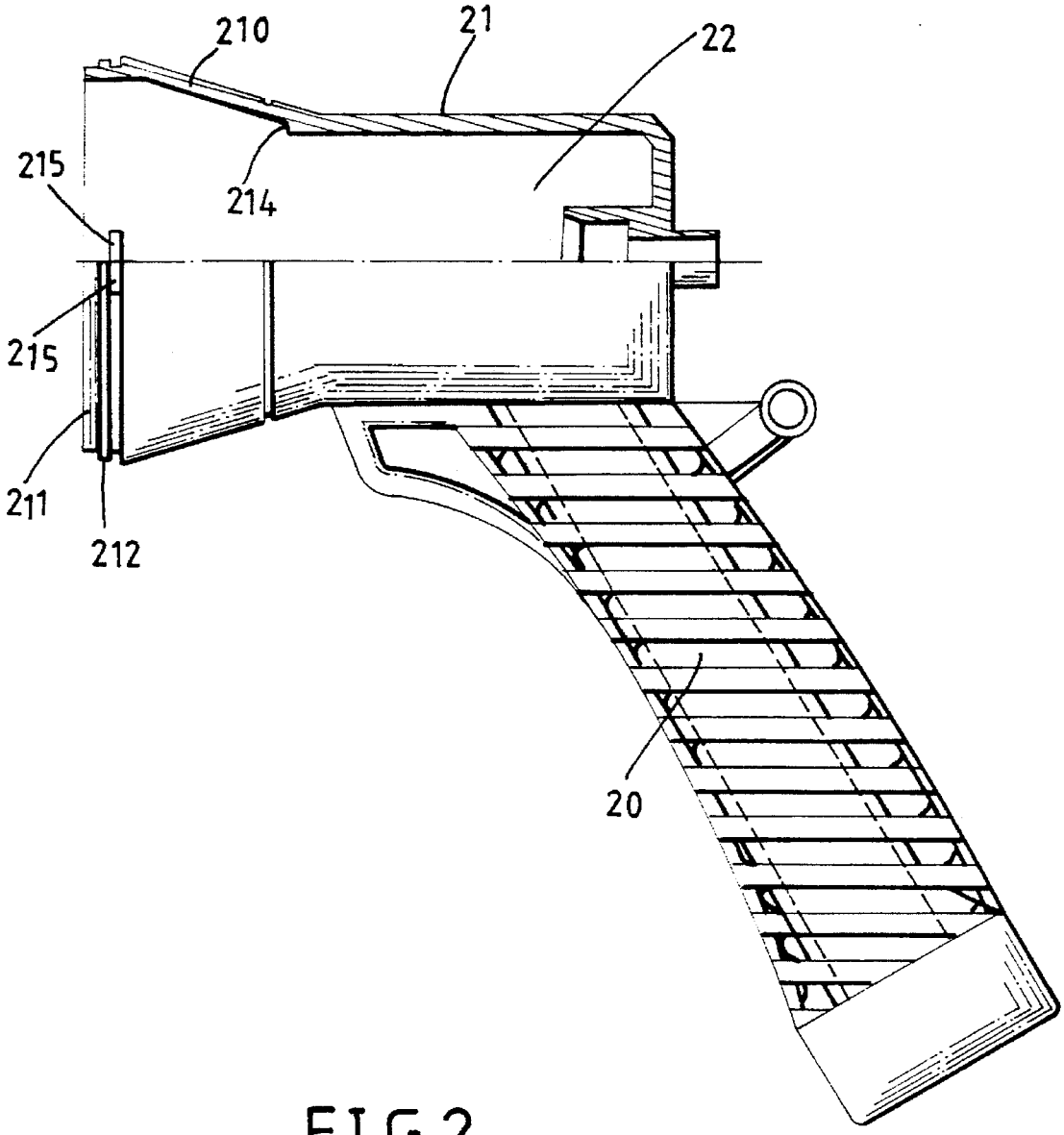
FIG. 2 is a side view of the water spraying gun which includes a portion cut off.
Figure 2A:
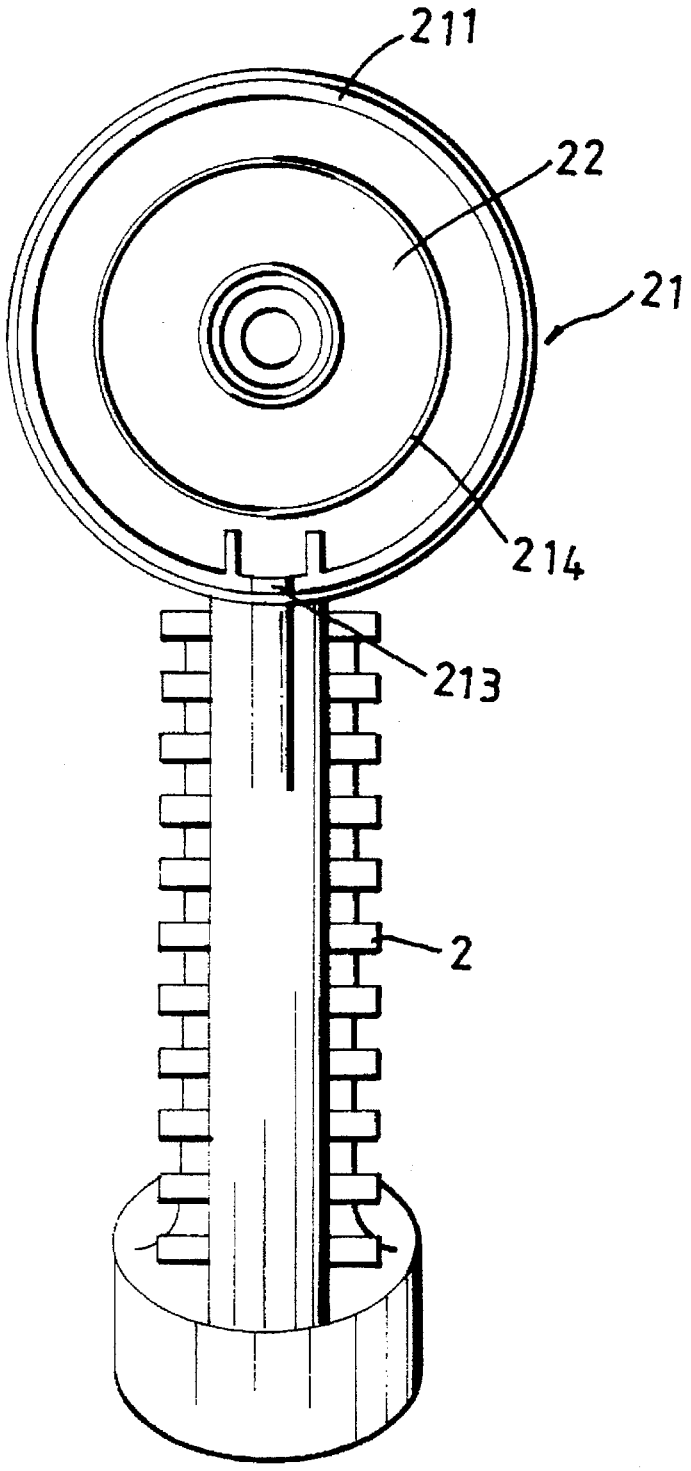
FIG. 2A is a front view of the water spraying gun.
Figure 3A:
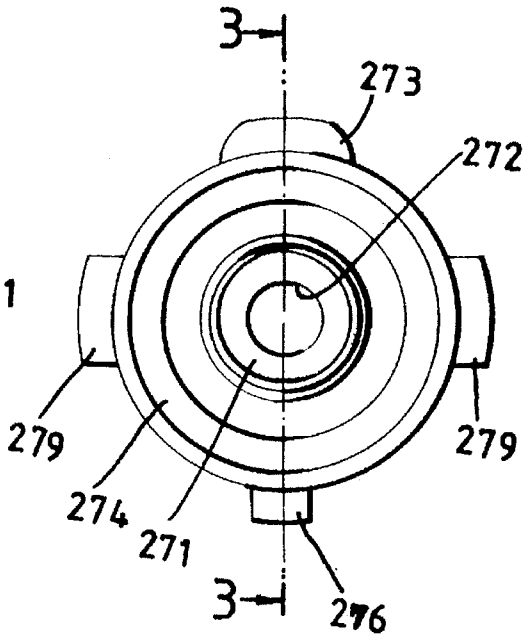
FIG. 3A is a rear end view of the element as shown in FIG. 3.
Figure 3:
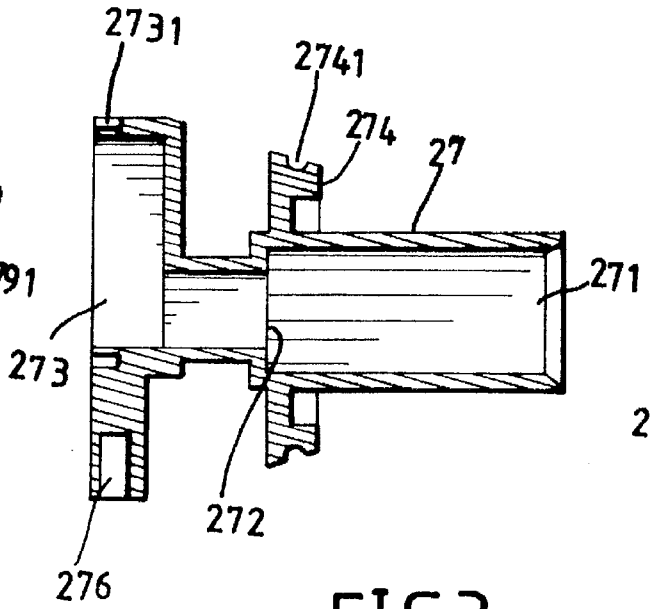
FIG. 3 is a cross sectional view taken along lines 3—3 of FIG. 3A.
Figure 3B:
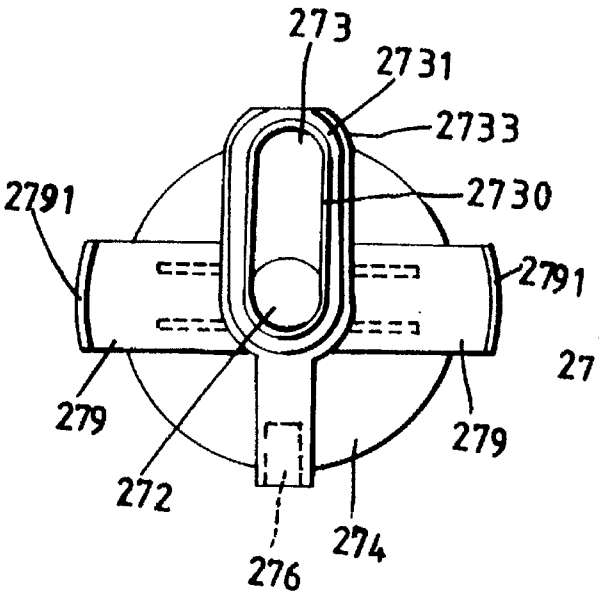
FIG. 3B is a front end view of the element as shown in FIG. 3.
Figure 2B:
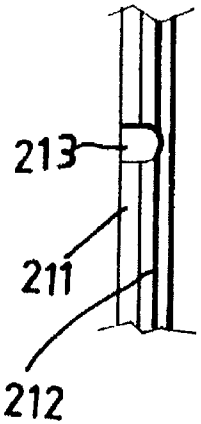
FIG. 2B is a partial bottom view of the water spraying gun.

Referring to FIGS. 1, 1A, 1B, 1C, 2, 2A and 2B, a water spraying gun in accordance with the present invention comprises a hand grip 2 having a water passage 20 formed therein and a gun body 21 secured on top of the hand grip 2. The gun body 21 includes a water conduit 22 formed therein and communicating with the water passage 20 of the hand grip 2. The gun body 21 includes a frustum 210 formed in the front portion and includes an annular shoulder 214 formed in the middle portion thereof. The frustum 210 includes an annular flange 211 formed in the front portion and an annular rib 212 extended from the annular flange 211. The annular flange 211 includes two side portions each having a puncture 215 formed therein (FIGS. 1C and 2) and includes a bottom portion having a notch 213 formed therein (FIGS. 2A and 2B). A handle 24 is pivotally coupled to the rear portion of the hand grip 2 and includes an upper portion having a wall member 241 extended therein and located behind the body 21.

Referring next to FIGS. 3, 3A, 3B and 3C, and again to FIGS. 1, 1A, 1B and 1C, a tube 27 is engaged in the gun body 21 and includes a water passageway 271 communicating with the water conduit 22 of the gun body 21. The tube 27 includes a mouth 272 of reduced diameter formed in the middle portion and includes a ring 274 extended radially outward from the middle portion for engaging with the annular shoulder 214 of the gun body 21. The ring 274 includes an annular slot 2741 formed in the outer peripheral surface for engaging with a sealing ring 2742 which makes a water tight seal between the ring 274 and the gun body 21. The tube 27 includes a room 273 formed in the front portion and defined by a peripheral wall 2730 and another peripheral wall 2733 is provided around the peripheral wall 2730 so as to define an annular groove 2731 for receiving a sealing ring 2732 (FIG. 1). The room 273 is communicating with the water passageway 271 such that water is allowed to flow into the room 273 via the passageway 271 and the mouth 272 of the tube 27. The front portion of the tube 27 includes a hole 276 formed therein for receiving a spring 278 and a ball 277 (FIG. 1), and includes a pair of extensions 279 laterally extended outward therefrom. The extensions 279 each includes a tip 2791 for engaging with the punctures 215 of the annular flange 211 (FIG. 1C).

Figure 5A:
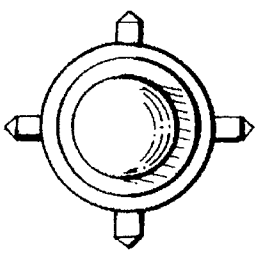
FIGS. 5A and 5B are end views of the piston rod.
Figure 5:
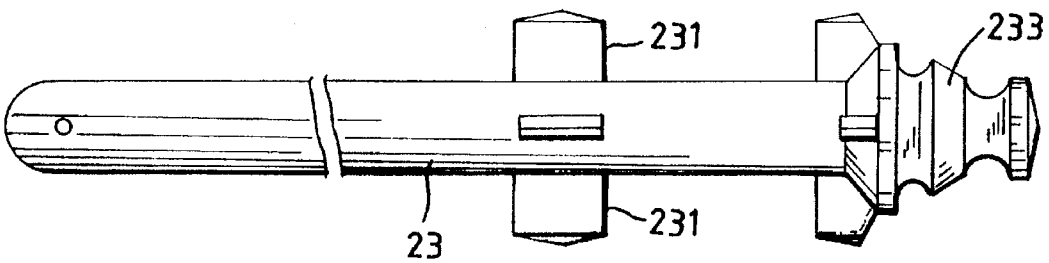
FIG. 5 is a side view of a piston rod.
Figure 5B:
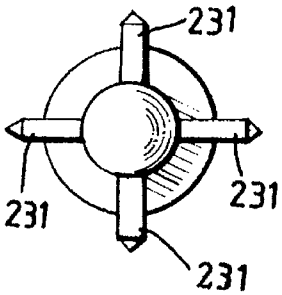
Figure 6A:
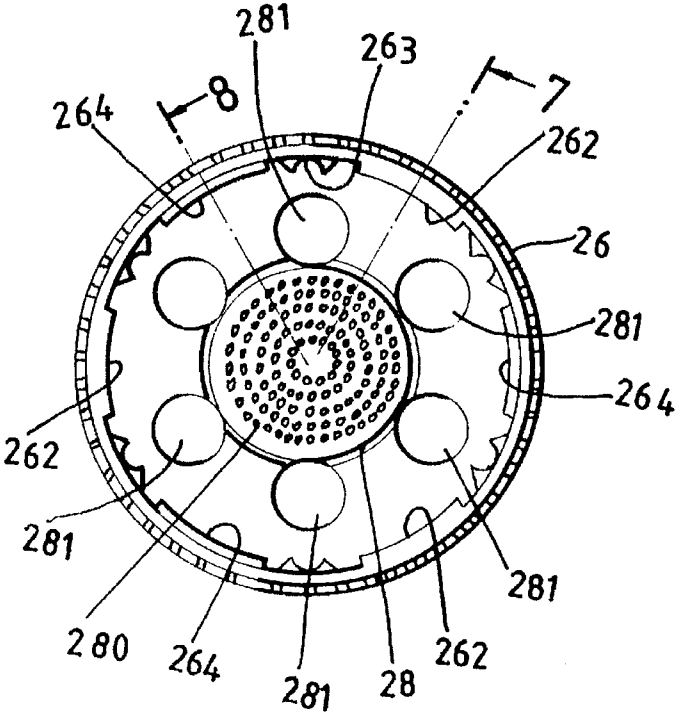
FIGS. 6, 6A, 6B are side view, rear view and front view of a cap.
Figure 6:
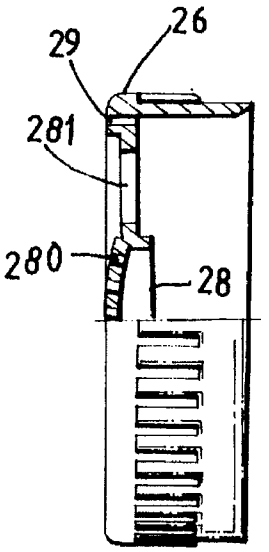
Figure 6B:
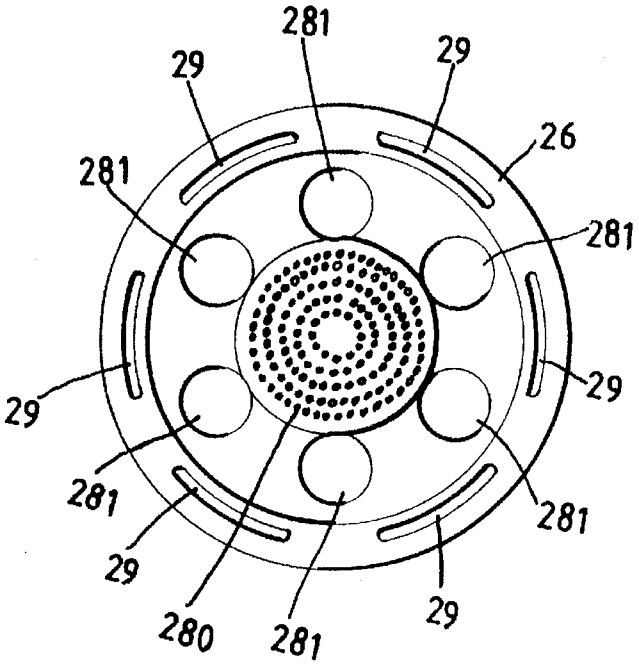
Figure 8:
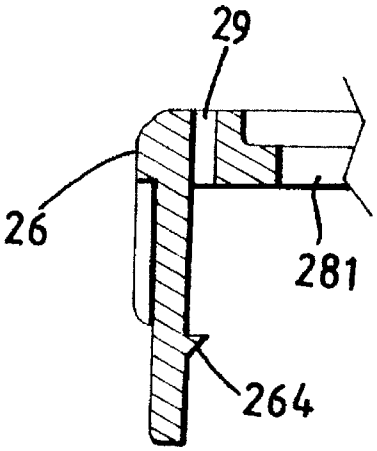
FIGS. 7 and 8 are cross sectional views taken along lines 7 and 8 of FIG. 6A.
Figure 7:
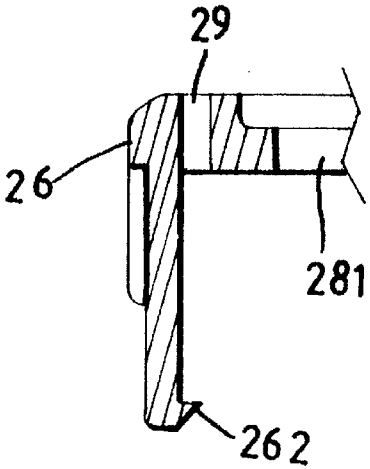

Referring next to FIGS. 5, 5h, 5B and again to FIG. 1, a piston rod 23 is slidably engaged in the tube 27 and includes four fins 231 extended radially in the middle portion for engaging with the tube 27 so as to support the piston rod 23 in place. The piston rod 23 includes a rear end coupled to the wall member 242 by a pin element 232 and includes a front end having a plug 233 provided thereon for engaging with the mouth 272 of the tube 27 and having a sealing ring 2330 (FIG. 1) engaged on the plug 233 for enclosing the mouth 272. A spring 241 (FIG. 1) is engaged between the fins 231 and the gun body 21 so as to bias the plug 233 to enclose the mouth 272. The plug 233 may be disengaged from the mouth 272 for opening the mouth 272 when the lower portion of the handle 24 is moved toward the hand grip 2 fly the users.

Referring next to FIGS. 6, 6h, 6B, 7 and 8, and again to FIGS. 1 and 1B, a control ferrule 26 is engaged onto the frustum 210 of the gun body 21 and includes a rear end portion having three ratchet teeth 262 extended radially inward therefrom for engaging with the annular rib 212 (FIGS. 6A, 7 and 1B) such that the control ferrule 26 is freely rotatable relative to the frustum 210. The control ferrule 26 includes a middle portion having three ratchet teeth 264 extended radially inward therefrom (FIGS. 6A, 8 and 1A) and arranged alternatively relative to the other ratchet teeth 196 best shown in FIG. 6A. The control ferrule 26 includes a front portion having a plurality of holes 280 formed in the center portion 28 thereof and having a number of orifices 281 arranged around the center portion 28, and having a number of curved slots 29 formed therein corresponding to the ratchet teeth 262, 264 for facilitating the molding processes of the ratchet teeth 262, 264. The control ferrule 26 includes an inner peripheral surface having a number of depressions 263 formed therein for engaging with the ball 277 (FIG. 1) which may position the control ferrule 26 relative to the gun body 21.

Figure 4:
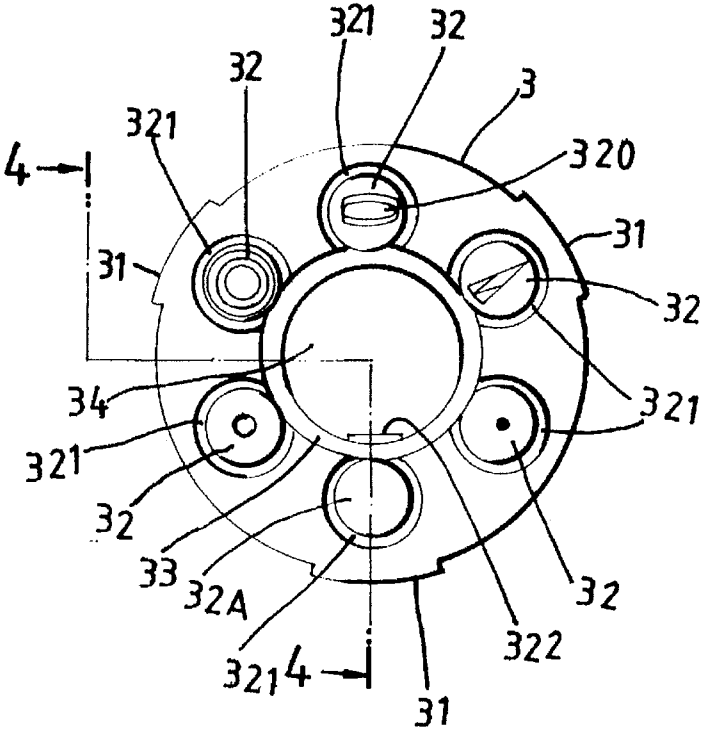
FIG. 4 is a front view of a nozzle element.
Figure 4A:
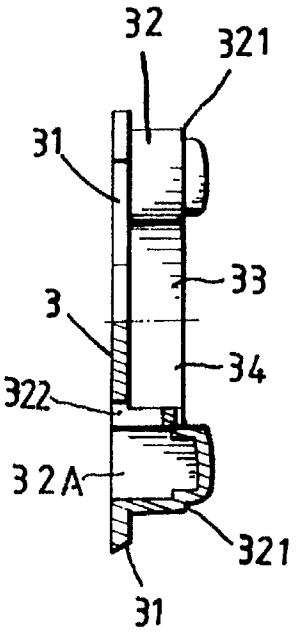
FIG. 4A is a partial cross sectional view taken along lines 4—4 of FIG. 4.
Figure 3C:
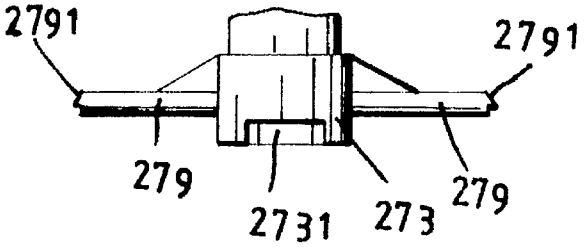
FIG. 3C is a partial side view of the element as shown in FIG. 3B.

Referring next to FIGS. 4 and 4A and again to FIGS. 1 and 1A, a control plate 3 is engaged in the control ferrule 26 and includes three ears 31 extended radially outward therefrom for engaging with the ratchet teeth 264 (FIG. 1A) such that the control plate 3 may be secured to the control ferrule 26. The control plate 3 includes six bulges 32 extended therefrom and each having a shoulder 321 for engaging with the orifices 281 of the control ferrule 26. Five of the bulges 32 each includes an aperture 320 formed therein for forming various types of water spraying forms; and the other bulge 32A has no aperture formed therein and includes a channel 322 for communicating with the center space 34 which is enclosed by a peripheral wall 33. When the control ferrule 26 is rotated, either of the bulges 32 may be aligned with the room 273 such that water may flow into either of the bulges 32 and may flow out of the spraying gun via either of the openings 320. As shown in FIG. 1, when the bulge 32A is aligned with the room 273, water may flow into the center space 34 via the channel 322 and water may flow out of the spraying gun via the holes 280 of the control ferrule 26.

Accordingly, the water spraying gun in accordance with the present invention includes a piston rod whose rear end does not extended outward beyond the handle such that the handle includes a smooth outer surface that will not hurt people.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A water spraying gun comprising:

a gun body including a rear portion having a hand grip extended downward therefrom, said gun body including a water conduit and said hand grip including a water passage formed therein and communicating with said water conduit of said gun body, said hand grip including a rear portion said gun body including a front portion having an annular flange formed thereon and having an annular rib extended radially outward from said annular flange, a control ferrule engaged on said front portion of said gun body, said control ferrule including a front portion having a center portion and having a plurality of orifices formed around said center portion, said center portion of said front portion of said control ferrule including a plurality of holes formed therein, said control ferrule including a rear portion having a first engaging means for engaging with said annular rib of said gun body so as to rotatably engage said control ferrule to said gun body, said control ferrule including a middle portion having a ratchet tooth means extended radially inward therefrom, a control plate including ear means extended radially outward therefrom for engaging with said ratchet tooth means so as to secure said control plate to said control ferrule, said control plate including a plurality of bulges extended therefrom for engaging with said room of said tube and each having an opening formed therein for forming various kinds of water spraying forms, handle pivotally coupled to said rear portion of said hand grip and including an upper portion having a wall member provided therein, a tube engaged in said gun body and including a middle portion having a mouth formed therein and including a front portion having a first peripheral wall formed therein so as to define a room, said room being communicating with said mouth and said tube, a piston rod slidably engaged in said tube and including a rear end coupled to said wall member of said handle and including a front end having a plug for engaging with and for enclosing said mouth, said piston rod including a middle portion having a plurality of fins extended radially outward therefrom for engaging with said tube so as to support said piston rod in place, and means for biasing said plug to engage with and to enclose said mouth of said tube.

* * * * *